US007236101B2

(12) United States Patent
Halishak

(10) Patent No.: US 7,236,101 B2
(45) Date of Patent: Jun. 26, 2007

(54) MULTIPLE EMERGENCY VEHICLE ALERT SYSTEM

(76) Inventor: Richard T. Halishak, 4313 E. Sprague Rd., Seven Hills, OH (US) 44131

( * ) Notice: Subject to any disclaimer, the term of this patent is extended or adjusted under 35 U.S.C. 154(b) by 50 days.

(21) Appl. No.: 10/808,893

(22) Filed: Mar. 25, 2004

(65) Prior Publication Data

US 2004/0189490 A1 Sep. 30, 2004

Related U.S. Application Data

(60) Provisional application No. 60/458,239, filed on Mar. 31, 2003, provisional application No. 60/469,857, filed on May 12, 2003.

(51) Int. Cl.
*G08B 1/095* (2006.01)

(52) U.S. Cl. ..... 340/908; 340/901; 340/902; 455/78; 455/82; 455/83

(58) Field of Classification Search ..... 340/908, 340/901, 902, 903; 455/78, 82, 83
See application file for complete search history.

(56) References Cited

U.S. PATENT DOCUMENTS 4,443,790 A * 4/1984 Bishop ..... 340/539.23
4,747,064 A * 5/1988 Johnston ..... 702/176
5,235,329 A * 8/1993 Jackson ..... 340/902
5,307,060 A * 4/1994 Prevulsky et al. ..... 340/902
5,625,257 A * 4/1997 Nunn ..... 315/77
5,995,804 A * 11/1999 Rootsey et al. ..... 455/11.1
6,094,148 A * 7/2000 Henry et al. ..... 340/902
6,505,101 B1 * 1/2003 Brill ..... 701/2
6,630,892 B1 * 10/2003 Crockford et al. ..... 340/904
6,778,101 B2 * 8/2004 Turbeville et al. ..... 340/902
6,807,464 B2 * 10/2004 Yu et al. ..... 701/1
2002/0102961 A1 * 8/2002 Gibbons et al. ..... 455/404
2003/0141990 A1 * 7/2003 Coon ..... 340/902

* cited by examiner

*Primary Examiner*—Jeffery Hofsass
*Assistant Examiner*—Edny Labbees
(74) *Attorney, Agent, or Firm*—Tarelli, Sundheim, Covell & Tummino LLP

(57) ABSTRACT

A warning system for making known the presence of an emergency vehicle. A transmitter is mounted in an emergency vehicle that outputs a digital UHF/LMS signal that is detectable within a range. A receiver responds to the digital UHF/LMS signal from the transmitter and is mounted, most preferably to a dashboard of a motor vehicle. The receiver detects from the digital signal the type of emergency vehicle from which the digital signal is originating. In one embodiment the digital signal also includes a unique identifier for the transmitter rather than simply a generic discipline identifier such as police, fire, emergency etc. A visual indicator mounted to the motor vehicle is activated in response to the digital signal from the transmitter to warn a motorist in the motor vehicle of a presence of the emergency vehicle within the range of the transmitter and to warn the transmitting vehicle of the presence of other emergency vehicles within receiving range.

2 Claims, 1 Drawing Sheet

MULTIPLE EMERGENCY VEHICLE ALERT SYSTEM

RELATED APPLICATIONS

The present application claims priority from U.S. provisional application Nos. 60/458,239 filed Mar. 31, 2003 and 60/469,857 filed May 12, 2003 each entitled Multiple Emergency Vehicle Alert System.

FIELD OF THE INVENTION

The present invention concerns a visual dashboard mounted alert on any vehicle (private, commercial or emergency) that is activated by short range digital radio signal of universal frequency transmitted from one or more emergency vehicles while operating the emergency vehicle's emergency light bar with an electric siren (electrodynamic loudspeaker).

BACKGROUND ART

In a modern day motor vehicle, efforts have been made to soundproof the passenger compartment. One result of such soundproofing is that the driver may be unable to hear approaching emergency vehicle having its audio siren turned on. Alternatively, the playing of a radio or stereo at loud volume may make the driver unable to hear an approaching emergency vehicle with the audio siren on. A hearing impaired driver may be unable to hear an approaching emergency vehicle with its siren on. Two or more emergency vehicles of the same or different disciplines, responding to the same or to different dispatchers, approaching the same intersection may not be able to hear the other approaching emergency vehicle due to the audible sound of his or her own siren and hence is unaware of the presence of another emergency vehicle responding to the same or a different emergency call.

If the emergency vehicle is using a silent approach, motorists in the vicinity will not be aware of the presence of the emergency vehicle approaching an intersection if the siren is not turned on. An emergency vehicle (or other patient transport vehicle) transporting a patient and not using an audio siren poses a risk to other motorists who will be unaware of the approaching emergency vehicle.

SUMMARY OF THE INVENTION

The aforementioned problems are addressed by use of UHF/LMS signals for activating a motor vehicle mounted warning receiving device. Police, Fire, EMS or other emergency vehicles that are authorized to cross intersections against a stop signal will be equipped with a Multiple Emergency Vehicle Alert System (MEVAS) transmitting warning device. Such warning device will be sensed by any MEVAS receiving device mounted in any vehicle (private, commercial and emergency) within a specified range such as 1500-2000 feet.

In one embodiment of the invention, a single universal UHF/LMS frequency shall be used by all Governmental Agencies which will be received by all vehicles, within range, including any other emergency vehicles. The signal transmitted will be digital and one code will be the same for each discipline (Fire, Police etc) of emergency vehicle. A second frequency code will be sent by a transmitter and will identify the transmitting vehicle with a unique ID. An omni antenna will be used with eash transmitter.

The RF transmitters will be assigned to only specific government agencies whose vehicles are authorized to cross intersections against stop lights. Specific examples are Police, Fire, Emergency Medical Services and others such as funeral escort services. Two or more radio dispatchers controlling emergency vehicles of different disciplines or radio dispatchers of different government agencies are not involved in these transmissions, thereby eliminating delay or third party human error.

The universal UHF/LMS frequency should be recognized across jurisdictional boundaries. A vehicle (private passenger or commercial) traveling intercity or interstate equipped with a MEVAS receiving unit must be able to receive the UHF/LMS signal of any emergency vehicle transmitting in its vicinity whether in the State of New York or the State of California.

These and other objects advantages and features of the invention will become apparent from a detailed description of an exemplary embodiment of the invention which is described in conjunction with the accompanying drawings.

EXEMPLARY EMBODIMENT FOR PRACTICING THE INVENTION

Figure 1:
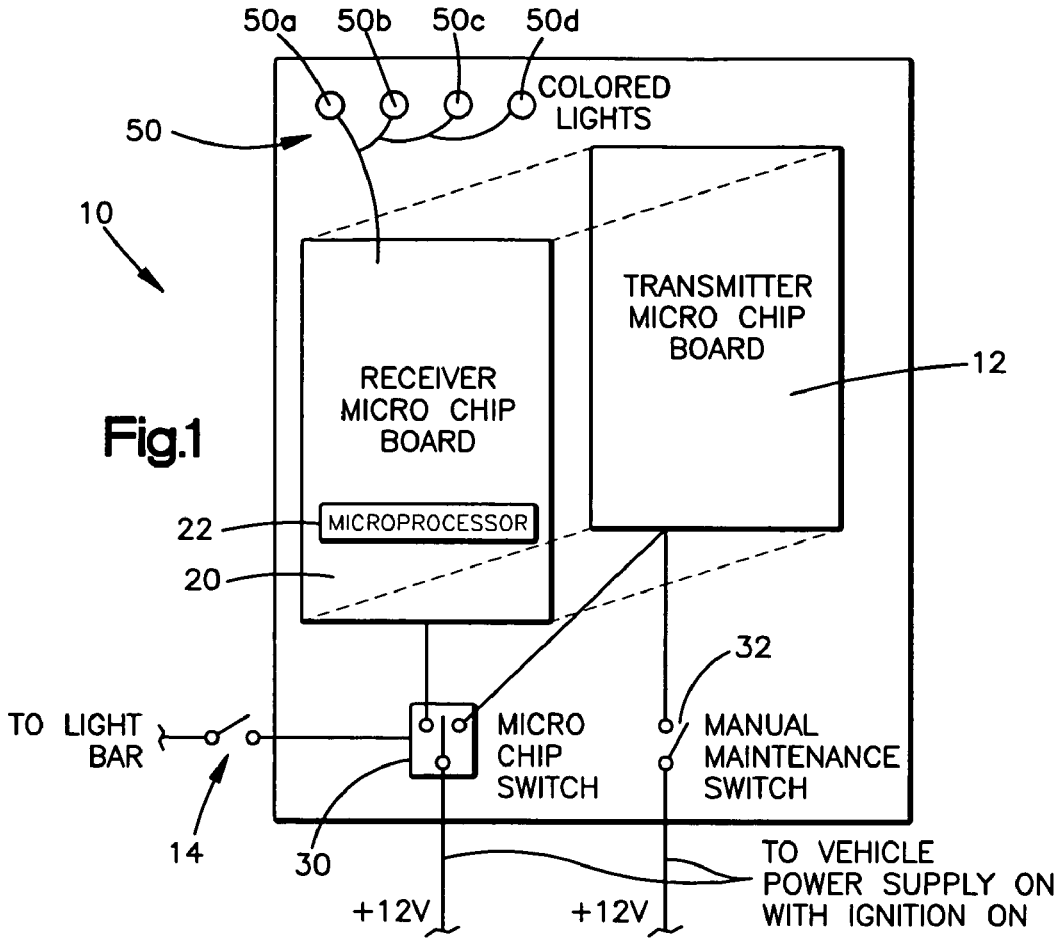
FIG. 1 schematic diagram of a system constructed in accordance with the invention for use in an emergency vehicle.
Figure 2:
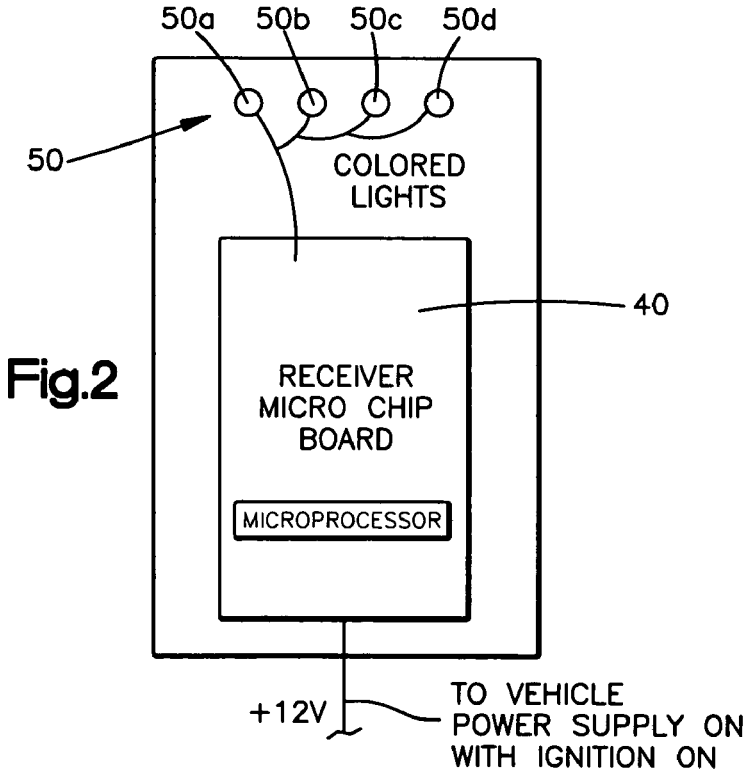
FIG. 2 is a schematic diagram of a receiver only system for use with a private or non-emergency vehicle.

FIGS. 1 and 2 depict representative embodiments of apparatus for use in implementing a warning system in accordance the invention. Each safety or emergency discipline (Police, Fire, EMS and other) is assigned one of four Identifying codes to be transmitted. Each of the vehicles employed by these agencies is equipped with a Multiple Emergency Vehicle Alert System 10 (MEVAS) UHF/LMS having a transmitter 12, which is activated by a switch 14 that is coupled to its emergency light bar. The system 10 for this type of vehicle also includes a MEVAS receiver 20. Each transmitter 10 shall be capable of up to 1 (one) Watt of RF output to control the range of the transmission. Each transmitter/receiver unit includes a microchip switch 30 to transmit during a millisecond transmit interval followed by a 3 to 5 seconds off interval. During the transmitting millisecond, the switch 30 blanks the receiver 20 of the transmitting vehicle during its millisecond digital output. The receiver will be available to receive another other emergency vehicle or vehicles transmissing during the 3 to 5 second period between transmissions. This cycle shall be continuously repeated as long as the emergency vehicle is using its light bar so long as the switch 14 is closed. The 3 to 5 second cycle is chosen to avoid overlap between two emergency vehicles. As an example, if one has a 4 second cycle and a second has a 4.5 second cycle, they will be out of sync immediately after the first cycle. This cycle could also be made to vary randomly each time the light bar is activated.

The transmitter shall be constructed utilizing UHF/LMS tone coded frequencies. The transmitter may be integrated within the emergency light bar electronic system of emergency vehicles. The UHF/LMS signal transmitter shall be installed in only authorized emergency vehicles.

The receiver 20 is a solid state circuit and meets all minimum industrial, FCC and EIA standards. The receiver shall be compact for operation in the UHF/LMS band frequency and operate in vehicles with a 12 volt electrical system. The receiver includes a microprocessor 22 to read the identifier in the signal and activate the proper warning light. The receiver is a synthesized type model which allows field program changes of UHF/LMS frequencies and CTCSS tones. The system 10 shall incorporate state of the art integrated circuit technology and printed circuit board interconnections.

A stand alone Multiple Emergency Vehicle Alert System (MEVAS) receiver 40 (FIG. 2) unit shall be used in vehicles (private passenger or commercial) that are not equipped with MEVAS units installed during manufacture. In factory equipped vehicles, the MEVAS receiver 40 may be integrated in the AM/FM radio receivers. This receiver 40 is similar to the receiver 20 depicted in FIG. 1. So long as it is powered by the vehicle electrical system coupled through the vehicle ignition, the receiver 40 is listening for transmitter signals and in the exemplary embodiment this is the case so long as the ignition switch is in the run position.

The MEVAS receiver is activated whenever the motor vehicle ignition switch is on (the engine need not be running) and is thereby capable of receiving the UHF/LMS signal from a MEVAS transmitter. Each receiver 20 in an emergency vehicle is muted to its own transmitted signal for the duration of its own transmission and shall then immediately be capable of receiving any other transmitter's signal.

The receivers 20, 40 shall have the capability to read and translate the discipline I.D. code and shall make that identification on a dashboard digital display or dash board display lights 50. The display lights are treated to glow upon receipt of a signal and gradually fade to be capable of receiving the next impulse from the original transmitter or any other transmitter. The dash-board display lights in all MEVAS receivers shall have a single color light for each emergency discipline to allow the driver to identify the type of emergency approaching. Thus, for example the light 50*a* is blue and corresponds to a police vehicle and the light 50*b* is red and corresponds to a fire department vehicle.

When an emergency vehicle activates its emergency light system and/or its sirens, the MEVAS transmitter 12 activates a short range pulsating digital universal UHF/LMS radio signal which shall be received by other vehicles, including other emergency vehicles, within a 1500 to 2000 foot distance. The use of one universal UHF/LMS frequency for each discipline of emergency vehicles shall provide the capability of extending beyond and shall afford a dependable alarm system regardless of present location and origin of that vehicle. The MEVAS UHF/LMS signal shall ensure that all receivers shall be capable of providing an effective alarm system even in an unfamiliar territory. The radio signal shall pulsate to serve multiple purposes. One is to attract the attention of the driver of other vehicles by its pulsating or flashing light. The second purpose is that no two Emergency Vehicles will pulse exactly concurrently and the driver of one Emergency Vehicle, with light bar/sirens on, will know that a second Emergency Vehicle, of any discipline, is approaching and within the 1500-2000 foot range with their sirens on also. Non-Emergency vehicle MEVAS receivers 40 shall identify the discipline of the transmitting emergency vehicle.

For normal maintenance, a manual switch 32 shall be provided in the transmitter to be used to verify its proper operation. This manual switch may also be used during a "silent approach" that allows the transmitter to operate even though the siren/light bar is not activated (switch 14 is open) due the transmitter 12 receiving +12 Volt power through the vehicle ignition switch Tables 1 and 2 below list representative specifications for the transmitters and receivers shown in the drawings.

TABLE 1

| Transmitter Specifications | |
|---|---|
| Frequency Range | 902 to 928 MHz-UHF/LMS |
| Channel Spacing | 25 KHz |
| Channel Capacity | 4 Minimum |
| R.F. Power Output | 1 Watt |
| Frequency Stability | +−2.50 ppm |
| Spurious & Harmonic Emission | <−36 dBm |
| Modulation Deviation | 5 KHz |
| FM Noise | 38 dB |
| Audio Distortion | <5% |
| Frequency Separation | Full Split |

TABLE 2

| Receiver Specifications | |
|---|---|
| Frequency Range | 902 to 928 MHz-UHF/LMS |
| Channel Spacing | 25 KHz |
| Channel Capacity | 4 Minimum |
| E.I.A. Sinad: (12 dB) | <−117.0 dBM |
| Selectivity | >70 dB |
| Frequency Stability | +−2.50 ppm |
| Spurious Rejection | >65 dB |
| Intermodulation | >70 dB |
| Audio Output | 0.5 Watts Min. with <5% distortion |
| Frequency Separation | Full Split |

While the present invention has been described with a degree of particularity, it is the intent that the invention include alterations and modifications from the disclosed design falling within the spirit or scope of the appended claims.

The invention claimed is:

1. A method of communicating a warning signal comprising:

mounting a transmitter and a receiver to an emergency vehicle that outputs a digital signal at periodic intervals that is detectable within a range;

said transmitter turning off its own signal at periodic intervals for 3-5 seconds to allow receipt by said receiver of a signal from other emergency vehicles in the vicinity;

mounting an additional receiver in a private or commercial motor vehicle that responds to the digital signal from the transmitter of a transmitting emergency vehicle to detect said digital signal;

transmitting a digital signal from the transmitter when an emergency vehicle light bar but not a siren of said emergency vehicle is actuated; and displaying a visual warning from a visual indicator mounted to the private or commercial motor vehicle or other emergency vehicle in response by a receiver of receipt of the digital signal from an emergency vehicle transmitter to warn a motorist in the private or commercial vehicle and/or an other emergency vehicle of a presence of the emergency vehicle whose light bar has been actuated is within said range.

2. Apparatus for communicating a warning signal comprising:

a transmitter in a first emergency vehicle that outputs a digital signal at periodic intervals that is detectable within a range and is periodically turned off from three to five seconds, said transmitter including means responsive to actuation of an emergency vehicle light bar for outputting said digital signal;

a receiver mounted to a private or commercial motor vehicle that responds to the digital signal from the transmitter in an emergency vehicle to detect said digital signal;

visual indicator mounted to the private or commercial motor vehicle that is activated in response to the digital signal from the transmitter of an emergency vehicle to warn a motorist in said motor vehicle of a presence of the emergency vehicle within said range; and a receiver and visual indicator mounted within the first emergency vehicle that responds to other transmitters in other emergency vehicles during the period the transmitted signal of the first emergency vehicle is turned off regardless of the government agency to which the emergency vehicle is assigned.

* * * * *